US009437924B2

(12) United States Patent
Sung et al.

(10) Patent No.: US 9,437,924 B2
(45) Date of Patent: Sep. 6, 2016

(54) ANTENNA STRUCTURE AND WIRELESS COMMUNICATION DEVICE USING SAME

(71) Applicant: Chiun Mai Communication Systems, Inc., New Taipei (TW)

(72) Inventors: Kun-Lin Sung, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 185 days.

(21) Appl. No.: 14/055,972

(22) Filed: Oct. 17, 2013

(65) Prior Publication Data

US 2014/0333483 A1 Nov. 13, 2014

(30) Foreign Application Priority Data

May 10, 2013 (TW) ..... 102116638 A

(51) Int. Cl.

| | |
|---|---|
| ***H01Q 5/00*** | (2015.01) |
| ***H01Q 1/24*** | (2006.01) |
| ***H01Q 5/371*** | (2015.01) |
| ***H01Q 9/04*** | (2006.01) |

(52) U.S. Cl.

CPC ..... *H01Q 5/371* (2015.01); *H01Q 1/243* (2013.01); *H01Q 9/0421* (2013.01)

(58) Field of Classification Search

CPC ..... H01Q 5/371; H01Q 1/243; H01Q 1/36; H01Q 5/378

See application file for complete search history.

(56) References Cited

U.S. PATENT DOCUMENTS

| | | | | |
|---|---|---|---|---|
| 2008/0018543 | A1* | 1/2008 | Baliarda | H01Q 1/243 343/702 |
| 2010/0026585 | A1* | 2/2010 | Pan | 343/700 MS |
| 2012/0293376 | A1* | 11/2012 | Hung | H01Q 1/2266 343/702 |

* cited by examiner

*Primary Examiner* — Dameon E Levi
*Assistant Examiner* — Ricardo Magallanes
(74) *Attorney, Agent, or Firm* — Zhigang Ma

(57) ABSTRACT

An antenna structure includes a first radiating body and a second radiating body. The first radiating body includes a feed portion, a first ground portion, a first extending portion, a second extending portion, and a third extending portion. The feed portion is electronically connected to the first ground portion. The first extending portion is electronically connected to the feed portion. The second extending portion is perpendicularly connected between the first extending portion and the third extending portion. The second radiating body includes a second ground portion and a combining portion electronically connected to the second ground portion. The combining portion is spaced from the third extending portion.

18 Claims, 3 Drawing Sheets

ANTENNA STRUCTURE AND WIRELESS COMMUNICATION DEVICE USING SAME

BACKGROUND

1. Technical Field

The disclosure generally relates to antenna structures and particularly to an antenna structure having a wider bandwidth and a wireless communication device using the antenna structure.

2. Description of Related Art

To communicate in multi-band communication systems, a bandwidth of an antenna of a wireless communication device such as a mobile phone needs to be wide enough to cover multiple frequency bands. Additionally, because of the miniaturization of the wireless communication device, space available for the antenna is limited. Therefore, it can be necessary to design the antenna to have the wider bandwidth within a reduced and limited space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
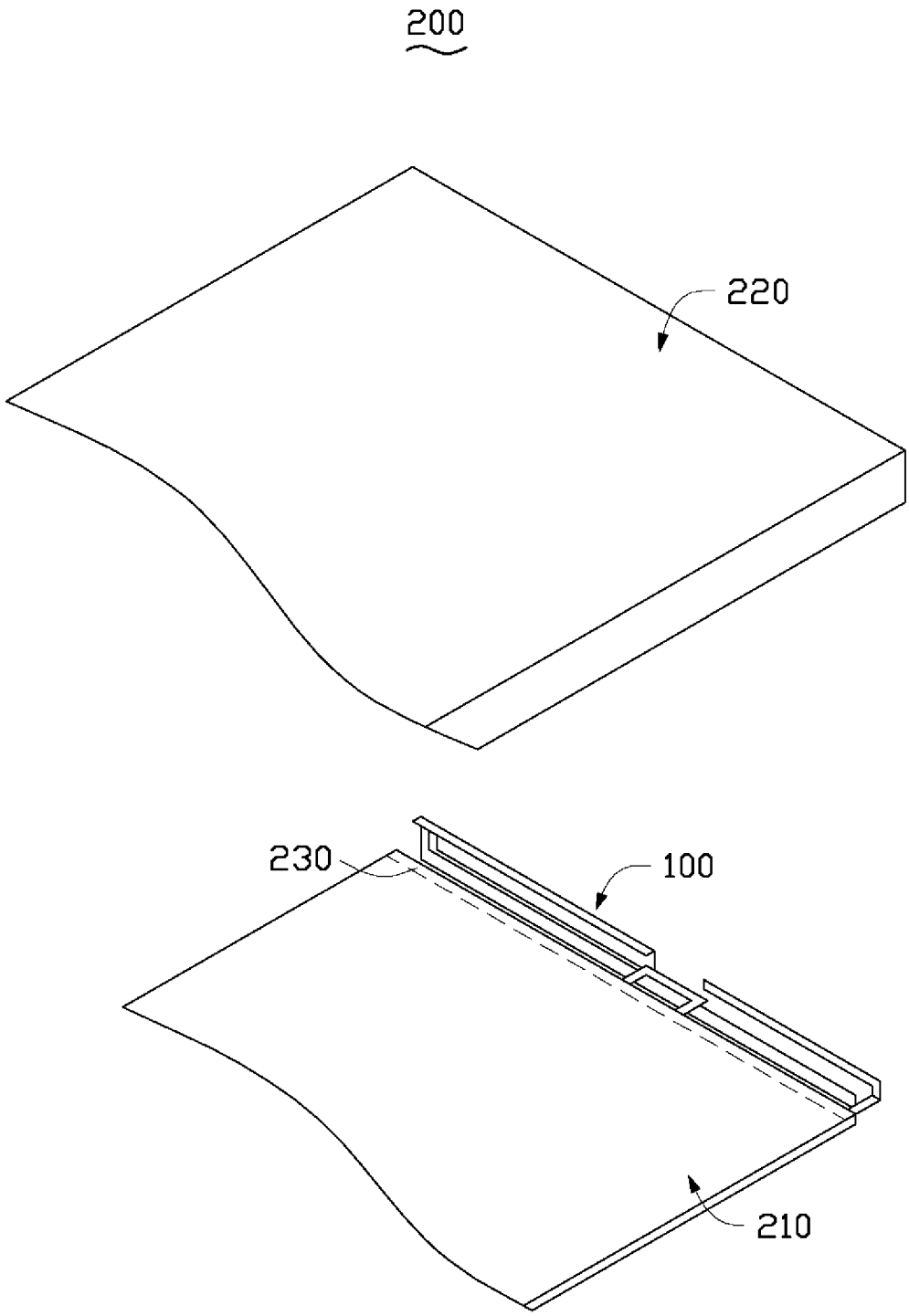
FIG. 1 is a schematic view of a wireless communication device having an antenna structure according to an exemplary embodiment.

FIG. 1 is a schematic view of an antenna structure 100 used in a wireless communication device 200, according to an exemplary embodiment. The wireless communication device 200 may be a mobile phone, a personal digital assistant, or a laptop computer.

The wireless communication device 200 includes a main board 210 and a housing 220. The antenna structure 100 is located at a side of the main board 210. The housing 220 shields the main board 210 and is configured to protect the antenna structure 100. The main board 210 has a keep-out-zone 230. The purpose of the keep-out-zone 230 is to not permit other electronic elements (such as a camera, a vibrator, a speaker, etc.) from being placed in a predetermined area where it may interfere with the antenna structure 100. In one exemplary embodiment, the keep-out-zone 230 is located at an end of the main board 210 and has a width about 3 millimeters (mm).

Figure 2:
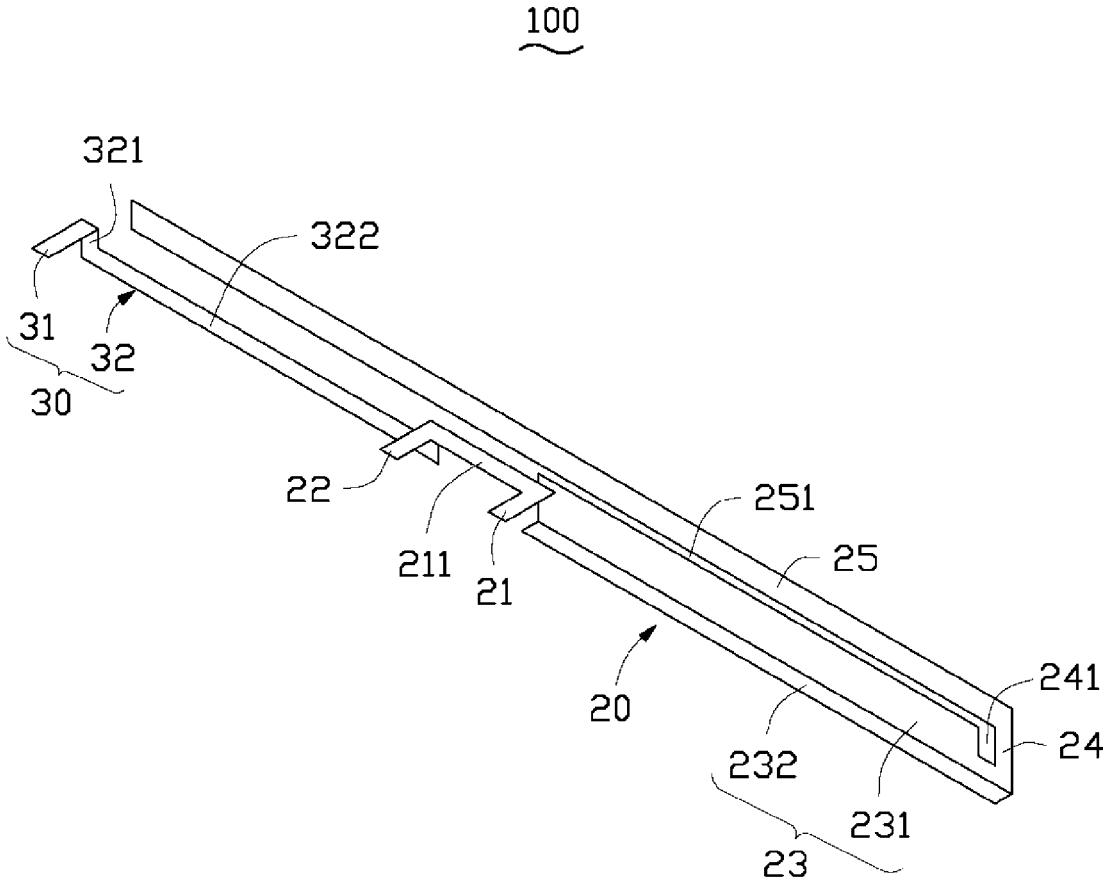
FIG. 2 is a schematic view of the antenna structure shown in FIG. 1.

FIG. 2 shows the antenna structure 100 including a first radiating body 20 and a second radiating body 30. Both the first radiating body 20 and the second radiating body 30 are adjacent to the keep-out-zone 230 to make the antenna structure 100 obtain a better radiating capability.

The first radiating body 20 includes a feed portion 21, a first ground portion 22, a first extending portion 23, a second extending portion 24, and a third extending portion 25. The feed portion 21 is substantially strip-shaped. The feed portion 21 and the main board 210 are coplanar. The feed portion 21 is electronically connected to a feed terminal (not shown) of the wireless communication device 200 and feeds current for the first radiating body 20.

The first ground portion 22 is substantially strip-shaped. The first ground portion 22 and the feed portion 21 are coplanar. The first ground portion 22 and the feed portion 21 are parallel to each other. A connecting portion 211 has one end perpendicularly connected to an end of the feed portion 21 away from the main board 210 and another end perpendicularly connected to an end of the first ground portion away from the main board 210. The feed portion 21, the first ground portion 22, and the connecting portion 211 cooperatively form a C-shaped structure. The first ground portion 22 is electronically connected to a ground terminal (not shown) of the wireless communication device 200 and provides a ground connection for the first radiating body 20.

The first extending portion 23 is electronically connected to the feed portion 21. The first extending portion 23 includes a first extending section 231 and a second extending section 232. The first extending portion 231 is positioned in a plane that is perpendicular to the plane in which the main board 210 is positioned. The first extending portion 231 is electronically connected to the feed portion 21. The second extending section 232 is positioned on a plane that is parallel to the plane in which the main board 210 is positioned. The second extending section 232 is perpendicularly connected to the first extending section 231.

The second extending portion 24 and the first extending section 231 are coplanar. The second extending portion 24 and the first extending section cooperatively form a first slot 241 between them. The third extending portion 25 and the first extending section 231 are also coplanar. The third extending portion 25 is perpendicularly connected to an end of the second extending portion 24, extends towards the first extending section 231, and is parallel to the first extending section 231. A length of the first extending section 231 is less than that of the third extending portion 25. The third extending portion 25 and the first extending section 231 cooperatively form a second slot 251 between them. The second slot 251 communicates with the first slot 241. In one exemplary embodiment, a length of the first extending portion 23 is about 28.5 mm. A length of the third extending portion 25 is about 56 mm. A width of the first extending section 231 is greater than that of the third extending portion 25 to feed current for the first radiating body 20 more effectively. A width of the second slot 251 is about 0.5 mm.

The second radiating body 30 includes a second ground portion 31 and a combining portion 32. The second ground portion 31 is substantially strip-shaped. The second ground portion 31 and the first ground portion 22 are coplanar. The second ground portion 31 is located at a side of the first ground portion 22 away from the feed portion 21, and is parallel to the first ground portion 22 and the feed portion 21. The combining portion 32 and the first extending section 231 are coplanar. The combining portion 32 is substantially L-shaped and includes a first combining section 321 and a second combining section 322. The first combining section 321 has one end perpendicularly connected to the second ground portion 31 and another end extending in a direction parallel to the second extending portion 24. The second combining section 322 has one end perpendicularly connected to an end of the first combining section 321 away from the second ground portion 31 and another end extending towards the first extending section 231. The second combining section 322 is parallel to the third extending portion 25 and spaced from the third extending portion 25. In one exemplary embodiment, a length of the second combining section 322 is about 22 mm.

When a current is input into the feed portion 21, the first extending portion 23 receives the current. The current from the feed portion 21 flows through the first extending portion 23, the second extending portion 24, and the third extending portion 25, and then the current is grounded by the first ground portion 22. Thus, the first radiating body 20 is activated for receiving and/or transmitting wireless signals having a first frequency band. In one exemplary embodiment, the first frequency band is about 824-960 megaHertz (MHz).

When the current flows through the third extending portion 25, due to a distance between the second combining section 322 and the third extending portion 25 satisfies a radiation requirement of the wireless communication device 200, thus the current flowing through the third extending portion 25 is coupled to the combining portion 32. The current coupled to the combining portion 32 is further grounded by the second ground portion 31. Thus, the second radiating body 30 is activated by the third extending portion 25 for receiving and/or transmitting wireless signals having a second frequency band. In this exemplary embodiment, the second frequency band is about 1710-2170 MHz.

Figure 3:
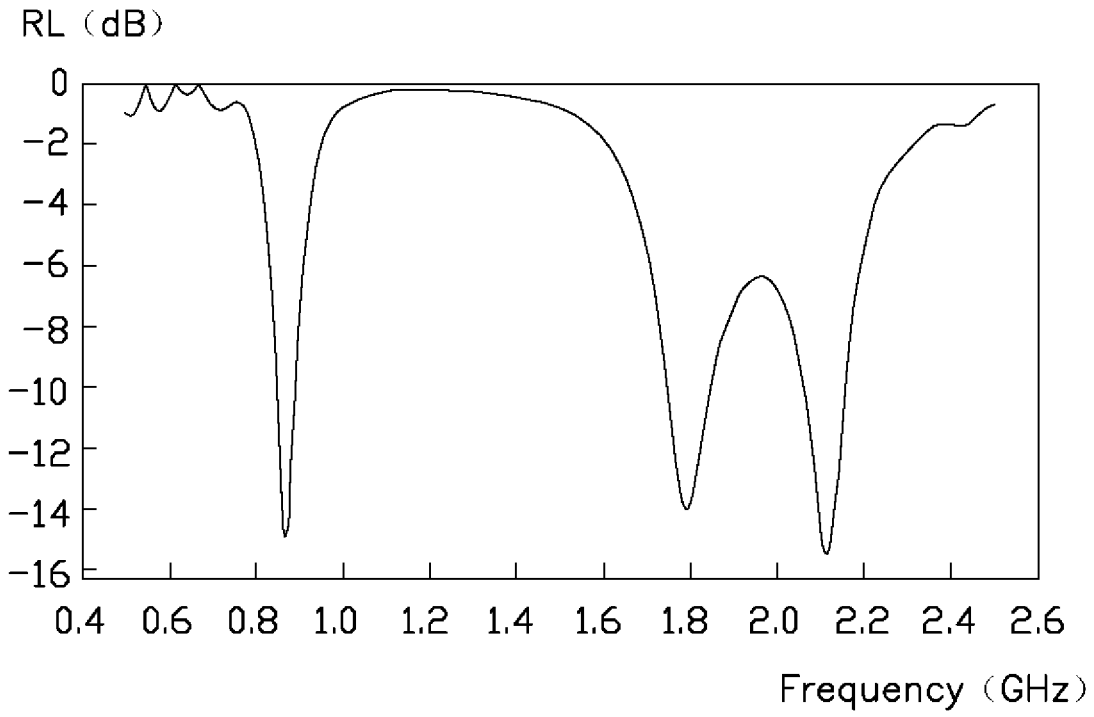
FIG. 3 is a return loss (RL) graph of the antenna structure shown in FIG. 2.

FIG. 3 shows a return loss graph of the wireless communication device 200. The wireless communication device 200 has a good performance when operating at the first frequency band (824-960 MHz) and the second frequency band (1710-2170 MHz), and satisfies radiation requirements.

In summary, the combining portion 32 of the second radiating body 30 is separated and spaced from the third extending portion 25 of the first radiating body 20, thus a current flowing through the third extending portion 25 is coupled to the combining portion 32. In this way, the second radiating body 30 serves as an antenna for the antenna structure 100 to obtain multiple working frequency bands, so that the antenna structure 100 has a better radiating performance. In addition, the first radiating body 20 and the second radiating body 30 are located at a same side of the main board 210, and the first extending section 231, the second extending portion 24, the third extending portion 25, and the combining portion 32 are coplanar, which can effectively utilize a space of the wireless communication device 200 and cost less.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a first radiating body comprising a feed portion, a first ground portion, a connecting portion, a first extending portion, a second extending portion, and a third extending portion; the feed portion, the first ground portion, and connecting portion being positioned coplanar; the feed portion electronically connected to the first ground portion; the first extending portion electronically connected to the feed portion, the second extending portion perpendicularly connected between the first extending portion and the third extending portion, wherein the first extending portion comprises a first extending section and a second extending section, the first extending section is positioned at a plane perpendicular to a plane of the second extending section and a width of the first extending section is greater than that of the second extending section; and a second radiating body comprising a second ground portion and a combining portion electronically connected to the second ground portion; wherein the combining portion is spaced from the third extending portion and comprises a first combining section and a second combining section positioned coplanar with the first combining section, the first combining section has one end perpendicularly connected to the second ground portion and another end extending in a direction parallel to the second extending portion; the second combining section has one end perpendicularly connected to an end of the first combining section away from the second ground portion and another end extends towards the first extending section.

2. The antenna structure of claim 1, wherein the first ground portion and the second ground portion are coplanar.

3. The antenna structure of claim 1, wherein the first ground portion and the feed portion are parallel to each other, the connecting portion is perpendicularly interconnected between the feed portion and the first ground portion.

4. The antenna structure of claim 2, wherein the first extending section is electronically connected to the feed portion, the second extending section is perpendicularly connected to the first extending section.

5. The antenna structure of claim 1, wherein the second extending portion and the first extending section are coplanar and cooperatively form a first slot between them.

6. The antenna structure of claim 5, wherein the third extending portion and the first extending section are coplanar and cooperatively form a second slot between them, the second slot communicates with the first slot.

7. The antenna structure of claim 1, wherein the combining portion and the first extending section are coplanar.

8. A wireless communication device, comprising:

a main board; and an antenna structure positioned at a side of the main board, the antenna structure comprising:

a first radiating body comprising a feed portion, a first ground portion, a connecting portion, a first extending portion, a second extending portion, and a third extending portion; the feed portion, the first ground portion, and connecting portion being positioned coplanar; the feed portion electronically connected to the first ground portion; the first extending portion electronically connected to the feed portion, the second extending portion perpendicularly connected between the first extending portion and the third extending portion, wherein the first extending portion comprises a first extending section and a second extending section, the first extending section is positioned at a plane perpendicular to a plane of the second extending section and a width of the first extending section is greater than that of the second extending section; and a second radiating body comprising a second ground portion and a combining portion electronically connected to the second ground portion; wherein the combining portion is spaced from the third extending portion and comprises a first combining section and a second combining section positioned coplanar with the first combining section, the first combining section has one end perpendicularly connected to the second ground portion and another end extending in a direction parallel to the second extending portion;

the second combining section has one end perpendicularly connected to an end of the first combining section away from the second ground portion and another end extends towards the first extending section.

9. The wireless communication device of claim 8, wherein the first radiating body and the second radiating body are positioned in a same side of the main board.

10. The wireless communication device of claim 8, further comprising a housing, wherein the housing shields the main board and protects the antenna structure.

11. The wireless communication device of claim 8, wherein the first ground portion and the second ground portion are coplanar.

12. The wireless communication device of claim 8, wherein the first ground portion and the feed portion are parallel to each other, the connecting portion is perpendicularly interconnected between the feed portion and the first ground portion.

13. The wireless communication device of claim 11, wherein the first extending section is electronically connected to the feed portion, the second extending section is perpendicularly connected to the first extending section.

14. The wireless communication device of claim 8, wherein the second extending portion and the first extending section are coplanar and cooperatively form a first slot between them.

15. The wireless communication device of claim 14, wherein the third extending portion and the first extending section are coplanar and cooperatively form a second slot between them, the second slot communicates with the first slot.

16. The wireless communication device of claim 8, wherein the combining portion and the first extending section are coplanar.

17. The wireless communication device of claim 8, wherein the wireless communication device works at a first frequency band about 824-960 MHz and a second frequency band about 1710-2170 MHz.

18. The wireless communication device of claim 16, wherein a length of the first extending portion is about 28.5 mm, a length of the third extending portion is about 56 mm, and a length of the second combining section is about 22 mm.

* * * * *